US005249844A

United States Patent [19]

Gronseth

[11] Patent Number: 5,249,844

[45] Date of Patent: Oct. 5, 1993

[54] BOREHOLE MINING PROCESS FOR RECOVERY FOR PETROLEUM FROM UNCONSOLIDATED HEAVY OIL FORMATIONS

[75] Inventor: James M. Gronseth, Calgary, Canada

[73] Assignee: Exxon Production Company, Houston, Tex.

[21] Appl. No.: 762,283

[22] Filed: Sep. 19, 1991

[30] Foreign Application Priority Data

Sep. 21, 1990 [CA] Canada ..... 2025996

[51] Int. Cl.[5] ..... E21C 25/60; E21C 45/00

[52] U.S. Cl. ..... 299/17; 175/67

[58] Field of Search ..... 299/3, 5, 7, 8, 16, 299/17; 175/67, 69

[56] References Cited

U.S. PATENT DOCUMENTS

| | | | |
|---|---|---|---|
| 2,251,916 | 8/1941 | Cross | 299/17 X |
| 3,730,592 | 5/1973 | Wenneborg et al. | 299/17 |
| 3,880,470 | 4/1975 | Davis, II | 299/17 |
| 3,938,600 | 2/1976 | Essmeier | 175/67 X |
| 3,951,457 | 4/1976 | Redford | 299/5 |
| 3,957,308 | 5/1976 | Lambly et al. | 299/14 |
| 4,059,166 | 11/1977 | Bunnelle | 175/232 |
| 4,109,715 | 8/1978 | Adamson | 299/5 |
| 4,140,346 | 2/1979 | Barthel | 299/17 |
| 4,212,353 | 7/1980 | Hall | 166/303 |
| 4,437,706 | 3/1984 | Johnson | 299/7 |
| 4,728,152 | 3/1988 | Pike et al. | 299/17 |

FOREIGN PATENT DOCUMENTS

| | | | |
|---|---|---|---|
| 1021809 | 11/1977 | Canada . | |
| 1023397 | 12/1977 | Canada . | |
| 1026387 | 2/1978 | Canada . | |
| 1034867 | 7/1978 | Canada . | |
| 1035394 | 7/1979 | Canada . | |
| 1063011 | 9/1979 | Canada . | |
| 1063012 | 9/1979 | Canada . | |
| 2206823 | 8/1972 | Fed. Rep. of Germany | 299/17 |
| 1511400 | 9/1989 | U.S.S.R. | 299/17 |

*Primary Examiner*—David J. Bagnell
*Attorney, Agent, or Firm*—Kelly A. Morgan

[57] ABSTRACT

A borehole mining process for recovery of petroleum from unconsolidated heavy oil formations. The process consists of drilling a borehole in the unconsolidated heavy oil reservoir, which is formed from sand particles aggregated by heavy oil, and positioning a casing and a first and second tubing string within the borehole. At least one nozzle is positioned on the lower end of the second tubing string and is oriented for fluid emission generally radially outwardly from the second tubing string. Fluid is then flowed downwardly through the second tubing string and outwardly through the nozzle, thereby eroding a cavity in the reservoir and forming a slurry consisting of the fluid, the heavy oil, and the particles from the reservoir. The slurry is flowed upwardly through the annulus between the first and second tubing strings to the upper end of the borehole for recovery of the heavy oil.

17 Claims, 2 Drawing Sheets

BOREHOLE MINING PROCESS FOR RECOVERY FOR PETROLEUM FROM UNCONSOLIDATED HEAVY OIL FORMATIONS

FIELD OF THE INVENTION

This invention relates generally to a method for recovering petroleum from unconsolidated heavy oil subterranean formations. More specifically, but not by way of limitation, the invention pertains to a method for recovery of bitumen from tar sands by borehole hydraulic mining.

BACKGROUND OF THE INVENTION

Petroleum is found in subterranean formations or reservoirs in which it has accumulated. In many cases the petroleum may be recovered by penetrating the reservoir with a well and allowing the fluid to flow to the surface as a result of natural pressure existing in the reservoir or, where there is insufficient natural pressure, by pumping the fluid to the surface. However, in many reservoirs the petroleum is too viscous to flow to the well by natural forces or to be economically pumped to the well. This type of petroleum is commonly known as "heavy oil'8. An example of a formation which contains an extremely viscous type of heavy oil is the Athabasca tar sands formation located in Alberta, Canada. The heavy oil in this formation, and in various other formations located throughout the world, is commonly known as "bitumen".

The processes used to recover bitumen from tar sand deposits include surface mining and in-situ processes. Generally, with surface mining processes, the overburden of the formation is mechanically removed and the tar sand is mechanically broken-up and transported to the processing site so the bitumen can be removed from the sand. However, surface mining is usually used only when the overburden of the formation is thin enough that it can be economically removed. When surface mining is not economically feasible, in-situ processes are often used instead.

In-situ processes utilize techniques for producing the bitumen from the sand within the tar sands deposit, rather than on the surface. Accordingly, the bitumen is transported to the surface and a major portion of the sand is left in the tar sands deposit. Some of these processes, commonly known as thermal recovery methods, include cyclic steam simulation, steam flooding, and in-situ combustion. Generally, thermal recovery methods utilize steam to input mass and heat energy to the reservoir in order to reduce the viscosity of the bitumen and supplement the drive energy of the reservoir, thereby enabling the bitumen to flow through the reservoir to the well at economic rates.

Although thermal recovery methods have proven to be viable processes, they require large capital investments for steam generation, steam transmission, and hot fluid treating facilities. The operating costs associated with these methods are usually high because of the cost of fuels required to generate steam. In addition, the success of thermal recovery methods is very dependent on reservoir quality. Relatively small variations in bitumen and water saturations, reservoir thickness, and clay content, among other reservoir characteristics, may have a significant impact on production rates and ultimate bitumen recovery.

Because of the problems associated with surface mining and in-situ separation, various hydraulic mining methods have been suggested as alternatives for recovery of bitumen from tar sands. Historically, hydraulic mining methods have been used to recover gold, coal, phosphate, uranium, and bauxite ores. One hydraulic mining method proposed for recovery of bitumen from tar sands is commonly known as "borehole mining". Generally, borehole mining is a process whereby the reservoir matrix and the fluid it contains are physically removed from the reservoir by the cutting and erosive action of water jets which access the reservoir from wellbores. The reservoir matrix and associated fluid are produced as a slurry by circulation and are transported by slurry pipeline to a plant for processing. Following completion of the mining operations, the reservoir cavity is backfilled with produced sand to control subsidence and to minimize the volume of sand which must be stored on the surface or otherwise disposed of.

Although various borehole mining methods have been proposed for recovering bitumen from tar sands, none utilize the novel enhancements described herein.

SUMMARY OF THE INVENTION

The present invention is a method for recovering petroleum from unconsolidated heavy oil subterranean formations. The process consists of drilling a borehole into the unconsolidated heavy oil reservoir, which is formed from sand particles aggregated by heavy oil, and positioning a casing in the borehole such that the upper end of the casing is positioned adjacent to the upper end of the borehole and the lower end of the casing is spaced apart from the lower end of the borehole. A first tubing string is then positioned in the casing such that the upper end of the tubing string is positioned adjacent to the upper end of the borehole and the lower end of the tubing string is positioned between the lower end of the casing and the lower end of the borehole. Next, a second tubing string is positioned in the first tubing string, thereby forming an annulus between the first tubing string and the second tubing string. The second tubing string has an upper end which is positioned adjacent to the upper end of the borehole and a lower end which is positioned between the lower end of the first tubing string and the lower end of the borehole. Further, at least one nozzle is positioned on the lower end of the second tubing string and is oriented for fluid emission generally radially outwardly from the second tubing string. Fluid is then flowed generally downwardly through the second tubing string and outwardly through the nozzle into the unconsolidated heavy oil reservoir. A cavity is eroded in the heavy oil reservoir by the flow of the fluid, and a slurry consisting of the fluid, the heavy oil, and the particles from the reservoir is formed. The slurry is then flowed generally upwardly through the annulus between the first tubing string and the second tubing string to the upper end of the borehole for recovery of the heavy oil

DETAILED DESCRIPTION OF THE PREFERRED EMBODIMENT

The present invention will be described and illustrated as a method for recovering petroleum from unconsolidated heavy oil subterranean formations. More specifically, the invention pertains to a method for recovery of bitumen from tar sands by borehole hydraulic mining. To the extent that the following detailed description is specific to a particular embodiment or a particular use of the invention, this is intended to be by way of illustration only and not by way of limitation.

The embodiments of the invention described herein provide a practical and economical process for producing heavy oil from an unconsolidated heavy oil reservoir at higher production rates and to higher ultimate recoveries than can be realized with present thermal in-situ processes. Further, although borehole mining has been suggested as a method of recovering heavy oils from unconsolidated heavy oil formations, the process and enhancements described herein present a new and novel approach of borehole mining for recovery of heavy oil.

Figure 1:
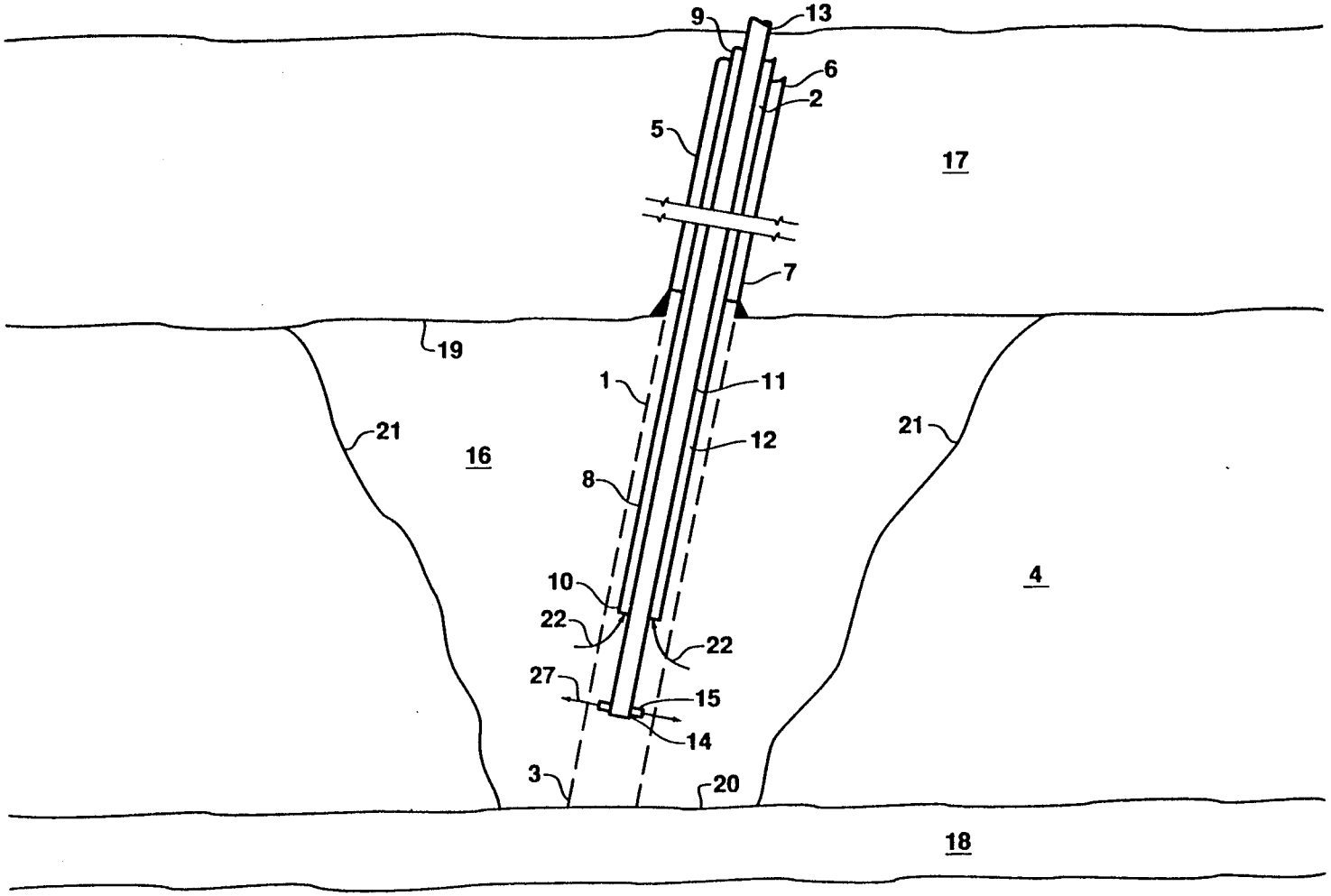
FIG. 1 is a cross sectional view of a heavy oil formation and deviated well illustrating recovery of the slurry through the annulus formed by the first tubing string and the second tubing string.

Referring now to FIG. 1, Applicant's inventive process comprises first drilling a borehole 1 through the overburden 17, the borehole 1 having an upper end 2 and a lower end 3, into an unconsolidated heavy oil reservoir 4 formed from sand particles aggregated by heavy oil. Casing 5 is then positioned in the borehole 1 such that the upper end 6 of the casing 5 is adjacent to the upper end 2 of the borehole 1 and the lower end 3 of the casing 5 is spaced apart from the lower end 3 of the borehole 1. The borehole 1 will generally have a diameter in the range of 5"-50", usually between about 10" and 30", and preferably in the range of 12"-24". The outer diameter of the casing 5 will generally be at least 80% of the borehole 1 diameter.

Following positioning of the casing 5 within the borehole 1, a first tubing string 8 is positioned in the casing 5 such that the upper end 9 of the tubing string 8 is positioned adjacent to the upper end 2 of the borehole 1 and the lower end 10 of the tubing string 8 is between the lower end 7 of the casing 5 and the lower end 3 of the borehole 1. A second tubing string 11 is then positioned within the first tubing string 8, thereby forming an annulus 12 between the first tubing string 8 and the second tubing string 11. The upper end 13 of the second tubing string 11 is positioned adjacent to the upper end 2 of the borehole 1 and the lower end 14 of the second tubing string 11 is positioned between the lower end 10 of the first tubing string 8 and the lower end 3 of the borehole 1. Further, at least one nozzle 15 is positioned on the lower end 14 of the second tubing string 11 and is oriented for fluid emission generally radially outwardly from the axis of the second tubing string 11, preferably, generally radially outwardly. Standard methods, which are well known to those skilled in the art, for drilling and casing a borehole and positioning the tubing strings 8 and 11 and nozzle or nozzles 15 may be used.

After drilling and casing the borehole 1 and positioning the tubing strings 8 and 11 and nozzle 15, fluid is flowed generally downwardly through the second tubing string 11 and outwardly through the nozzle 15 into the unconsolidated heavy oil reservoir 4. As a result of the fluid flowing through the nozzle 15, a cavity 16 is formed in the heavy oil reservoir 4. The fluid flowing from the nozzle 15 erodes the formation, causing the sand particles and heavy oil to disaggregate and release heavy oil contained in the pore spaces of the reservoir 4. A slurry consisting of the fluid, the heavy oil, and the particles from the reservoir 4 is formed thereby. As the flow of fluid continues, the slurry will flow generally upwardly (as indicated in FIG. 1 by arrows 22) through the annulus 12 between the first tubing string 8 and the second tubing string 11 to the upper end 2 of the borehole 1 for recovery of the heavy oil. Preferably, the slurry will be piped to a central plant (not shown) where the heavy oil will be treated for sale, the fluid will be recycled for re-use in the borehole mining operations, and the sand will be temporarily stockpiled on the surface prior to re-injection into depleted cavities created by the borehole mining process.

In a preferred embodiment, the fluid flowed through the second tubing string 11 into the reservoir 4 is liquid water. Generally, the water will be at a temperature in the range of 5° C. to 100° C., usually in the range of 10° C. up to approximately 100° C. Preferably, the water is at a temperature in the range of 10° C. up to about 80° C., most preferably in the range of 15° C. to 70° C. The fluid is preferably flowed downward through the second tubing string 11 using a surface pump or pumps (not shown). Generally, if surface pumps are used, kinetic energy imparted to the fluid from the pumps will force the slurry from the reservoir 4 into the annulus 12 between the first 8 and second 11 tubing strings. Accordingly, downhole slurry pumps, which are commonly used in borehole mining, will not be necessary.

The fluid is preferably injected at high injection rates and high pressures. Generally, the greater the injection rate, the greater the slurry production rate will be. The minimum injection rate will be governed by (a) the velocity required to transport the slurry up the annulus 12 between the first 8 and second 11 tubing strings and (b) the jet pressure required to cut or erode the reservoir 4. The greater the fluid injection rate, the greater the frictional pressure drop will be. The maximum fluid injection rate then will be governed by the lowest pressure rating of the following components: pump discharge, surface injection lines, wellhead and tubing. Friction pressure drop, and therefore maximum fluid injection rate, is further influenced by: the diameter of the jets used in the nozzle 15, the cross sectional area and wetted perimeter of the annulus 12 between the first 8 and second 11 tubing strings, and the viscosity and specific gravity of the produced slurry. Further, friction reducing agents could be added to the fluid being injected to reduce the frictional pressure drop and thereby increase the upper range of fluid injection rates and potentially increase slurry production rates.

As previously discussed, a cavity 16 in the heavy oil reservoir 4 will be formed by the flow of fluid through the nozzle 15 into the reservoir 4. Generally, the cavity 16 will have a ceiling 19 at an upper end, a floor 20 at a lower end, and walls 21 connecting the ceiling 19 and floor 20. Applicant's inventive process is preferably conducted so as to initiate and maintain instability in this cavity 16. By maintaining an unstable cavity 16, the reservoir material can be spalled or sloughed off the roof 19 and walls 21 of the cavity 16 with little added energy input. As the reservoir material spalls or sloughs away from the walls 21 and/or roof 19 of the cavity 16, it will fall to the floor 20 of the cavity 16 and will be contacted and disaggregated by the flow of fluid through the nozzle 15. The resulting slurry of fluid, heavy oil, and sand particles will be circulated generally upwardly through the annulus 12 between the first tubing string 8 and the second tubing string 11 to the upper end 2 of the borehole 1 for recovery of the heavy oil. By maintaining the cavity 16 in an unstable manner throughout the mining process, high recovery and production rates can be achieved without requiring the fluid flowing through the nozzle 15 to impinge directly on the tar sands formation.

Instability in the cavity 16 can be initiated and maintained using several techniques. Generally, to maintain an unstable cavity 16, the inventive process described herein may further comprise collapsing the ceiling 19 and walls 21 of the cavity 16. One such technique for collapsing the ceiling 19 and walls 21 comprises undercutting ("undercut mining") the foundation for the ceiling 19 and walls 21 by flow of the fluid. Undercut mining the reservoir 4 to a sufficient depth will induce tensile stresses in the roof 19 of the cavity 16. Because tar sands possess virtually no tensile strength, blocks of reservoir material will be created due to tensile cracks in the roof 19 of the cavity 16. These blocks will drop to the bottom 20 of the cavity 16 under the influence of gravity and will be broken up by the flow of fluid through the nozzle 15. As long as these blocks of failed material are removed from the cavity 16, the instability will propagate upwards and outwards until the stronger materials, such as shale cap rock 17 are encountered. Other techniques for enhancing and maintaining the instability of the cavity 16 which are a function of the low tensile strength of the geological materials in the reservoir 4 include imparting hydraulic transients in the cavity 16 against the ceiling 19 and walls 21 of the cavity 16 and detonating explosives positioned adjacent to the cavity 16.

Another technique for initiating and maintaining instability in the cavity 16 consists of reducing the pressure of the cavity 16. Reducing the pressure of the cavity 16 will result in a reduction in the radial stress exerted on the walls 21 of the cavity 16 and an increase in the compressive tangential stresses in the cavity walls 21, which leads to further instability in the cavity 16. The cavity pressure can be reduced by displacing the fluid from the wellbore 1 with a gas, such as nitrogen, which forms a gas cap in the cavity 16 and thereby promotes collapse of the ceiling 19 and thus further instability in the cavity 16. The cavity pressure can also be reduced by swabbing the second tubing string 11, thereby imparting hydraulic transients in the ceiling 19 and walls 21 of the cavity 16.

In addition to the foregoing, waterflood augmentation can be used to reduce the stability of the cavity. By injecting a fluid into a well positioned adjacent to the cavity being mined, the reservoir pressure in such cavity will increase, thereby reducing the effective stresses within the reservoir. Reducing the effective stresses acting at the cavity walls reduces the apparent strength of the reservoir and leads to further instability. Waterflood augmentation can also lead to higher recovery by displacing heavy oil contained in portions of the reservoir which cannot be mined due to geometrical constraints.

There are several advantages of maintaining an unstable cavity when performing the borehole mining process described herein, including: (1) minimization of the input energy required to achieve large extraction volumes because strain energy existing in the reservoir ,rather than kinetic energy from the flow of fluid through the nozzle, provides the energy required for cavity enlargement, (2) the downhole tools used for borehole mining will be much simpler and of lower costs than those required to achieve large extraction volumes from stable cavities, and (3) the operation of an unstable cavity is far simpler than operations designed to maintain a stable cavity.

Another aspect of Applicant's inventive borehole mining process comprises separating a portion of the heavy oil from the sand particles from the reservoir as the slurry flows up the annulus between the first and second tubing string. This separation step can be further enhanced by adding a surfactant or other surface active agent to the fluid. Generally, separation in the wellbore will be enhanced by the mechanical energy input from the flow of fluid through the nozzle into the reservoir, the turbulence in the wellbore 1 and surface piping, the effects of surface active agents, and/or the effects of solution gas.

Another aspect of Applicant's inventive borehole mining process is that it can be performed from vertical, deviated, or horizontal wells, whereas existing borehole mining technology requires that vertical wells be used. Generally, Applicant's borehole mining process may be enhanced further, especially when mining from a horizontal or deviated well, by repositioning the nozzle within the reservoir to allow mining to continue. To accomplish this, the lower end of the first tubing string is repositioned to a location within the casing and the lower end of the second tubing string is repositioned to a location between the lower end of the first tubing string and the lower end of the casing. Fluid is then flowed outwardly through the nozzle to cut off a portion of the casing to allow mining to continue. Removal of the casing as described above can be further enhanced by introducing abrasive particles such as sand into the fluid. This enhancement is especially useful when the well is a horizontal well because the entire wellbore of a horizontal well would, of necessity, be cased to maintain integrity. By removing the protective casing as described above, mining could be continued. Further, advantages of being able to perform the process from deviated or horizontal wells are that surface land disturbance and the cost of surface production facilities are minimized.

In one embodiment of the invention, after a cavity has reached its economic limit, it may be backfilled with previously mined sand from the same or a different reservoir. Generally, the sand will have been stockpiled at the central plant facility and transported via slurry pipeline to the cavity being backfilled. Water and oil displaced from the cavity during backfilling operations will be piped back to the central plant for processing. Upon completion of mining of a cavity within a reservoir, surface subsidence may be controlled by backfilling and through the mining sequence used. Mining may be sequenced so that two adjacent cavities are never operated together. Once a cavity has been backfilled, mining operation can begin on adjacent cavities.

Figure 2:
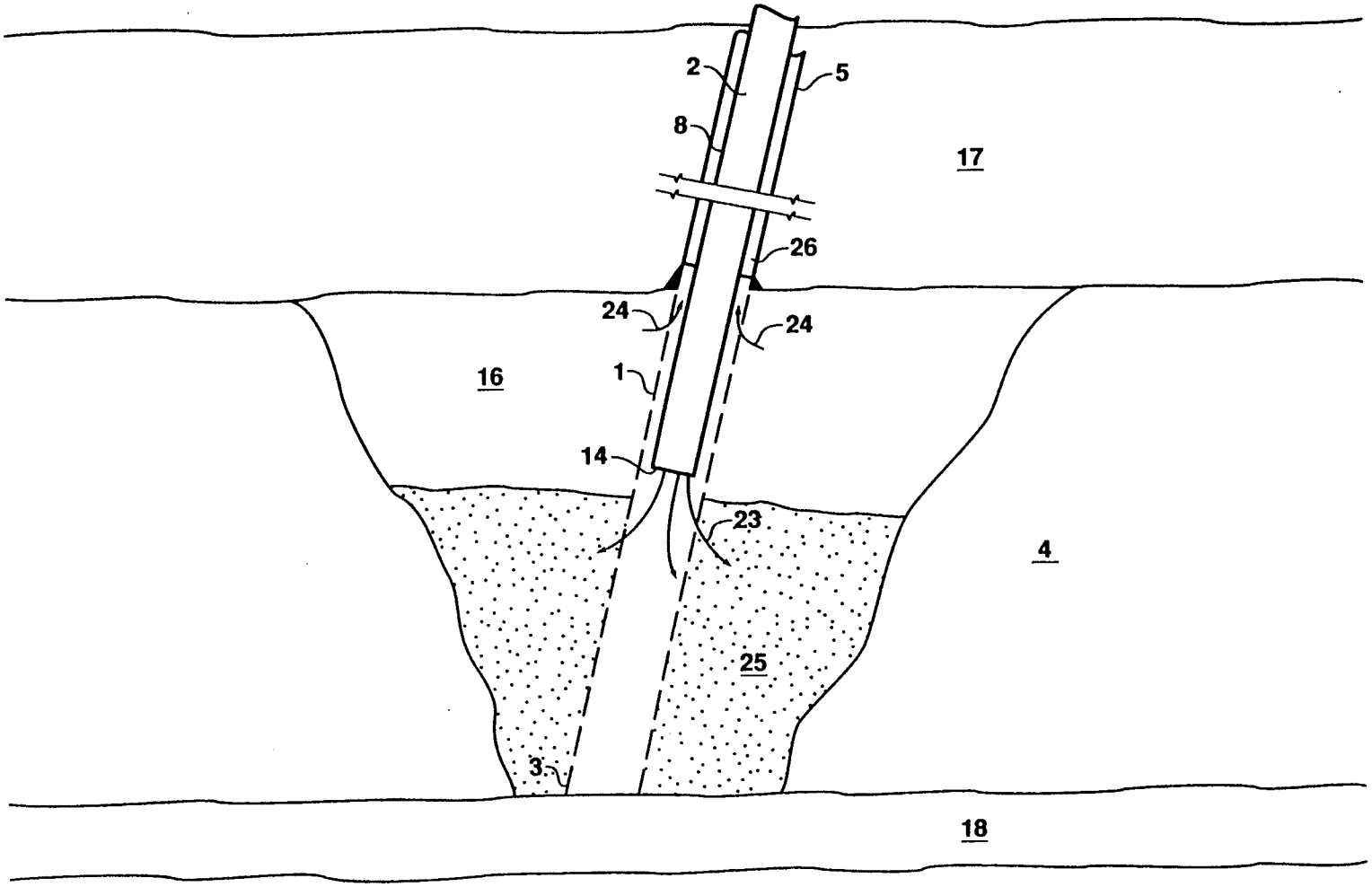
FIG. 2 is a cross sectional view of a heavy oil formation and deviated well illustrating recovery, after the second tubing string has been removed, of remaining oil through backfilling operations.

As described briefly above, to further enhance Applicant's inventive borehole mining process, the concept of mining sequencing may be incorporated by first separating the sand particles from the slurry recovered through the annulus between the first and second tubing strings during mining and then introducing the separated sand particles into a second cavity in the reservoir. Applicant's invention may also be enhanced by controlling surface subsidence by backfilling. FIG. 2 is a cross sectional view of a heavy oil formation and deviated well illustrating recovery through backfilling operations. After flowing the slurry generally upwardly through the annulus 12 between the first 8 and second 11 tubing strings to the upper end 2 of the borehole 1 for recovery of the heavy oil (as illustrated in FIG. 1), the process may be further enhanced by terminating the flow of fluid and withdrawing the second tubing string 11 from the casing 5. Refering now to FIG. 2, a slurry fluid and sand particles (as indicated by lines 23) from the reservoir 4 are then introduced into the cavity 16 through the first tubing string 8 and the fluid 24 is withdrawn from the cavity 16 through the annulus 26 between the first tubing string 8 and the casing 5, leaving the sand particles 25 in the cavity 16. The heavy oil and fluid remaining in the reservoir 4 are displaced by the sand particles 25 and are thereby recovered through the tubing/casing annulus 26.

Another method for controlling subsidence, and therefore an enhancement to Applicant's inventive process, is to first terminate the flow of fluid, after flowing the slurry generally upward through the annulus between the first and second tubing strings, and then withdraw both the first and second tubing strings from the casing. A second borehole is then drilled into the cavity, and sand particles recovered from another part of the same or a different reservoir are introduced into the cavity through the second borehole. As discussed above, the fluids which are displaced by the sand particles will be withdrawn through the tubing/casing annulus of the new borehole, leaving the sand particles in the cavity. This enhancement is especially useful in the case of horizontal wells.

Sand particles which are not disposed of by backfilling operations can be disposed of through hydraulically fracturing into disposal wells. In such operations, water is used as the carrier fluid and high injection rates are used to dispose of sand using low sand concentrations. This process can be incorporated into the backfilling operations described above. After all the sand that can be circulated into a depleted cavity has been placed, fracturing can be used to dispose of additional volumes of sand. Pressure packing and fracture disposal of the produced sand particles could also increase the effectiveness of backfilling as a subsidence control technique.

The inventive process of borehole mining described herein, and the various enhancements to that process, will enable higher heavy oil recoveries to be obtained in significantly shorter periods of time, with lower capital and operating costs than can be achieved with the present thermal bitumen recovery methods. Because the reservoir and the fluids it contains are physically removed from the ground, essentially all of the oil that is contained in the mined cavity is recovered. By careful planning of the mining strategy, cavities can be placed so as to access over 50% of the oil in place in the reservoir. Further, none of the factors which tend to limit recovery from thermal methods such as low heavy oil saturation, clay content, lack of conformance, thief zones, relative permeability effects, low permeability, high shale content, top water or gas, or bottom water will adversely impact borehole mining. Accordingly, the novelty of this process compared to thermal methods of heavy oil recovery is evident.

As described and illustrated herein, the present invention satisfies the ongoing need for a practical method for recovering petroleum from unconsolidated heavy oil subterranean formations. It should be understood that the invention is not to be unduly limited to the foregoing which has been set forth for illustrative purposes. Various alterations and modifications of the invention will be apparent to those skilled in the art without departing from the true scope of the invention, as defined in the following claims.

I claim:

1. A process comprising:

a) drilling a well borehole into an unconsolidated heavy oil reservoir formed from sand particles aggregated by heavy oil, said borehole having an upper end and a lower end;

b) positioning a casing in said borehole, said casing having an upper end positioned adjacent to the upper end of the borehole and a lower end which is spaced apart from the lower end of the borehole;

c) positioning a first tubing string in said casing, said first tubing string having an upper end positioned adjacent to the upper end of the borehole and a lower end positioned between the lower end of the casing and the lower end of the borehole;

d) positioning a second tubing string in said first tubing string, an annulus being formed between the first tubing string and the second tubing string, said second tubing string having an upper end positioned adjacent to the upper end of the borehole, a lower end positioned between the lower end of the first tubing string and the lower end of the borehole, and at least one nozzle positioned on the lower end of the second tubing string, said nozzle being oriented for fluid emission generally radially outwardly from the second tubing string;

e) flowing fluid generally downwardly through the second tubing string, outwardly through the at least one nozzle and into the unconsolidated heavy oil reservoir;

f) eroding a cavity in the heavy oil reservoir by flow of said fluid, the cavity having a ceiling at an upper end, a floor at a lower end, and walls connecting the ceiling and floor; and forming a slurry of said fluid, heavy oil and particles from the reservoir by collapsing the ceiling and walls of the cavity; and g) flowing the slurry the annulus between the first tubing string and the second tubing string to the upper end of the borehole for recovery of the heavy oil.

2. A process as in claim 1 wherein said well borehole is a vertical well borehole.

3. A process as in claim 1 wherein said well borehole is a horizontal well borehole.

4. A process as in claim 1 wherein said well borehole is a deviated well borehole.

5. A process as in claim 1 further comprising separating a portion of the heavy oil from the particles from the reservoir as the slurry flows up the annulus.

6. A process as in claim 5 further comprising enhancing said separation by adding a surface active agent to the fluid.

7. A process as in claim 1 further comprising undercutting the foundation for the ceiling and walls by flow of the fluid.

8. A process as in claim 1 further comprising hydraulically hammering the ceiling and walls of the cavity.

9. A process as in claim 8 wherein the second tubing string is swabbed to impart hydraulic transients in the ceiling and walls of the cavity.

10. A process as in claim 1 further comprising forming a gas cap in said cavity to promote collapse of the ceiling.

11. A process as in claim 1 further comprising injecting a fluid into a well positioned adjacent to the cavity.

12. A process as in claim 1 further comprising detonating explosives positioned adjacent to the cavity.

13. A process as in claim 1 further comprising a) repositioning the lower end of the first tubing string to a location within the casing;

b) repositioning the lower end of the second tubing string to a location between the lower end of the first tubing string and the lower end of the casing; and c) flowing fluid outwardly through the nozzle to cut off a portion of the casing.

14. A process as in claim 13 further comprising introducing abrasive particles into said fluid.

15. A process as in claim 1 further comprising a) separating the particles from the reservoir from the slurry; and b) introducing the thus separated particles into a second cavity in the reservoir.

16. A process as in claim 1 further comprising a) terminating the flow of fluid;

b) withdrawing the second tubing string from the casing, thereby forming an annulus between the first tubing string and the casing;

c) introducing a slurry fluid and particles from the reservoir into the cavity through the first tubing string; and d) withdrawing the fluid from the cavity through the annulus between the first tubing string and the casing.

17. A process as in claim 1 further comprising a) terminating the flow of fluid;

b) withdrawing the first tubing string and the second tubing string from the casing;

c) drilling a second borehole which intercepts the cavity; and d) introducing particles recovered from another part of the reservoir into the cavity through the second borehole.

* * * * *